US006318561B1

(12) United States Patent
Zampini et al.

(10) Patent No.: US 6,318,561 B1
(45) Date of Patent: Nov. 20, 2001

(54) AIR CLASSIFIER

(75) Inventors: Stefano Zampini, Augsburg; Marcus Adam, Stadtbergen; Georg Konetzka, Augsburg, all of (DE)

(73) Assignee: Hosokawa Alpine Aktiengesellschaft & Co. OHG, Augsburg (DE)

( * ) Notice: Subject to any disclaimer, the term of this patent is extended or adjusted under 35 U.S.C. 154(b) by 0 days.

(21) Appl. No.: 09/447,862

(22) Filed: Nov. 23, 1999

(30) Foreign Application Priority Data

Nov. 27, 1998 (DE) ..... 198 54 855

(51) Int. Cl.[7] ..... B07B 4/02

(52) U.S. Cl. ..... 209/714; 209/142; 209/719; 209/723

(58) Field of Search ..... 209/139.1, 139.2, 209/713, 714, 710, 712, 715, 145, 723, 719, 717, 711, 142, 143, 716, 721

(56) References Cited

U.S. PATENT DOCUMENTS

| | | | | |
|---|---|---|---|---|
| 302,608 | * | 7/1884 | Watson et al. | 209/714 |
| 2,561,388 | * | 7/1951 | Lykken et al. | 209/714 |
| 3,423,034 | * | 1/1969 | Hippert | 209/714 |
| 4,296,864 | * | 10/1981 | Misaka et al. | 209/135 |
| 4,799,595 | * | 1/1989 | Binder | 209/135 |
| 4,857,178 | | 8/1989 | Barthelmess . | |
| 4,869,786 | | 9/1989 | Hanke | 209/139.2 |
| 5,158,182 | | 10/1992 | Fischer-Helwig et al. . | |
| 5,232,096 | * | 8/1993 | Weit | 209/135 |
| 5,511,668 | * | 4/1996 | Keuschnigg | 209/135 |
| 5,788,727 | * | 8/1998 | Barthelmess | 55/406 |
| 6,109,448 | * | 8/2000 | Konetzka et al. | 209/135 |

FOREIGN PATENT DOCUMENTS

| | | |
|---|---|---|
| 39 24 826 | 1/1991 | (DE) . |
| 41 12 018 | 12/1991 | (DE) . |
| 40 40 890 | 5/1992 | (DE) . |
| 0 244 744 | 4/1987 | (EP) . |
| 0 519 535 A1 | 12/1992 | (EP) . |
| 1 004 366 A3 | 11/1999 | (EP) . |

* cited by examiner

*Primary Examiner*—Donald P. Walsh
*Assistant Examiner*—Daniel K Schlak
(74) *Attorney, Agent, or Firm*—Winston & Strawn

(57) ABSTRACT

This invention relates to an air classifier for the separation of granular material into three fractions, whereby each individual fraction is very precisely separated in a single housing. The classifier incorporates motor-driven separator/classifying wheels each of which is provided with a tangential separating-air supply at the level of the respective wheel, a fixed guide vane ring positioned at a radial distance from the circumference of the respective separating wheel, and at least one bulk-product feeder system as well as discharge provisions for fine, intermediate and coarse material, respectively. The wheels are provided with a closed cover disk at their respective first axial end and with fine and, respectively, medium fraction discharge port at their respective second axial end. The closed cover disks of the wheels form a free-flow gap in the space between the two stages of the classifier. An outward flow of air at the level of the upper and lower areas of the gap and an inward flow of air at the level of the center of the gap combine to produce a rotating eddy current or vortex in the separating zone. The vortex causes an extended dwell time of the dispersed bulk material particles in the transition zones of the two separating stages.

14 Claims, 10 Drawing Sheets

AIR CLASSIFIER

BACKGROUND OF THE INVENTION

Figure 1A:
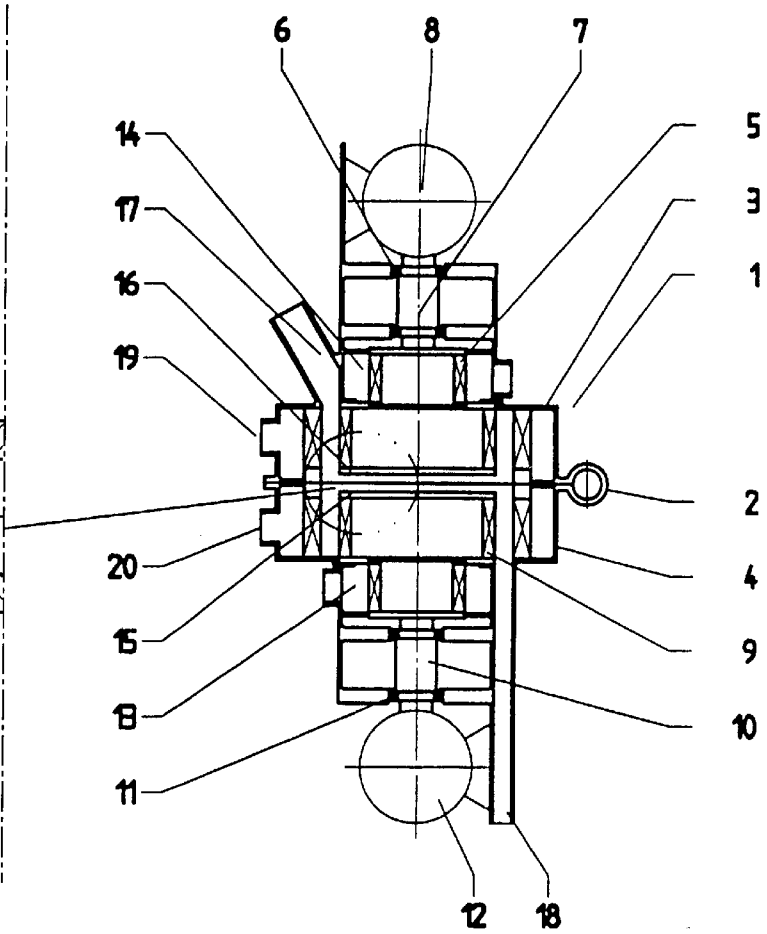

DE 41 12 018 A1 describes a classifier for the separation of granular bulk products into at least three fractions, the system incorporating in a vertical housing several classifying separator wheels concentrically interacting at a distance from one another. In that classifier system, the separating air stream passes through one classifying wheel after the other and each wheel has its own product separation parameters. In a derivative design version, the wheels are mounted in separate positions within the housing, each with its own independent drive. In a classifier of that type, the first separation takes place in the first separation stage at the outermost classifying wheel having the largest diameter, whereby the fine and intermediate fractions are separated from the coarse fraction. Any further fine fraction is obtained only from the fine and intermediate fractions derived from the first separation stage, meaning that the coarse fraction is exposed to only one single separation stage. To obtain high-quality coarse material, the coarse product requires intensive screening.

A coarse product fraction free of fine particles and thus free of dust is typically obtained by means of a classifier which permits intensive and nearly total separation of the bulk material and thus of the coarse fraction.

The air classifier described in the German patent DE 40 40 890 C1 employs an optimized level of effectiveness in separating the bulk-material feed into at least three streams of particles differentiated by grain size. It incorporates two concentrically interleaved separator wheels with blades which are large in axial direction. Due to this design concept, the bulk material remains in the separating zone over an extended distance, permitting nearly all fine and intermediate particles to be separated. But in this case as well, any further fine fractions are extracted only from the fine and intermediate fractions derived from the first separating stage. There is no second follow-up screening of the coarse material.

The European patent EP 0 244 744 B1 describes a centrifugal-force-operated classifier with an essentially cube-shaped housing containing several individually driven separator wheels each of which connects to a separate air/fine-fraction outlet The stated purpose of the separator wheels, arranged in a parallel, series or over-under configuration, is to provide a high-performance classifier capable of simultaneously delivering several different granular fractions.

With that classifier, the bulk material can be consecutively fed to several separator wheels, permitting repeated processing of the coarse fraction. However, since the separator wheels are always juxtapositioned at a relatively short distance from one another, they affect one another's performance.

This entails significant drawbacks. For example, not every one of the separator wheels has its own individual air intake, a fact that complicates the precise setting of the fractionating boundary of each individual classifying wheel. Due to the spatial, co-planar setup of the separator wheels and the cramped configuration it is possible for coarse material that is rejected by one of the wheels and radially hurled outwards to penetrate into the adjoining wheel in undesirable fashion, being interspersed with the fine-grain fraction of that wheel even though by virtue of the preset fractionating boundary of that wheel it should have been rejected. This design thus causes the fine and intermediate fractions to display an undesirably high content of coarse particles (sputter).

These drawbacks can be avoided by using a classifier per DE 39 24 826 A1 by positioning the wheels one above the other, suitably spaced apart A classifier of that type permits the separation of granular bulk material into at least three fractions. It consists of an essentially vertical housing with exit ports for the fine, intermediate and coarse material, with each separating wheel having its own air intake and its own conduit for exhausting the separating air stream.

Obtaining multi-stage separation of fine and coarse particles, each within tight grain-size tolerances by means of very crisp separation of the individual sizes, typically involves the use of several separate classifiers process-linked for fluidized or nonfluidized operation in a processing system by means of feeder systems such as pipelines. During the movement from one classifier to the next, complete redispersion of the particles in the air can occur. This is in fact necessary in order to establish optimal conditions in the downstream classifier for complete separation of the material.

Where several separating stages are combined in one housing, particle dispersion in the pipelines is no longer possible, requiring some other solution for dispersing the material between two separating stages. Per DE 39 24 826 A1, the particles to be separated would be circulated and loosened up in the transition space between the first separating stage and the second stage below it by making that transition space funnel-shaped. In enhanced designs, that funnel-shaped transition space would contain centrifugal fliers or centrifugal disk vanes serving to deagglomerate and/or break down the material.

Highly wear-resistant baffles mounted on the inside wall of the housing serve to protect the transition space against excessive wear. Unfortunately, apart from and due to the desired deglomeration, the high-velocity impact of the particles impinging on the inner housing wall leads to the formation of deposits and reagglomeration, especially when the inner housing wall is bombarded with an increased number of particles in the case of inadequate or altogether absent provisions for moving the particles away from the inner housing wall. For very sensitive products that need to be separated but should not yield only fine particles as the final fraction, for instance toners, an additional size reduction of the granules during the separation process is not desirable.

SUMMARY OF THE INVENTION

This invention is therefore aimed at providing an air classifier for the separation of granular material into three fractions, whereby each individual fraction can be very precisely separated in a single housing. As an additional objective, such precise separation of the bulk material is to be obtained in conjunction with safe handling of the particles, especially by avoiding any further size reduction, while at the same time providing optimal dispersion between the two separating stages, dissolving any existing agglomerations and reducing any wear in the dispersion zone.

The invention is based on a classifier incorporating on one side of a housing two motor-driven separator/classifying wheels each of which is provided with a tangential separafing-air supply at the level of the respective wheel, with a fixed guide vane ring positioned at a radial distance from the circumference of the respective separating wheel. The wheel is equipped with at least one bulk-product feeder system as well as discharge provisions for fine, intermediate and coarse material, respectively. The process product flows through the separating zone in the axial direction of the separator wheels.

To permit smooth dispersion in the transition zone of the two separating stages, the separator wheels employed are provided with a closed cover disk at their respective first axial end and with fine and, respectively, medium fraction discharge port at their respective second axial end. The wheels are positioned in a common housing and in such a way that the two first ends frontally face each other. This configuration creates a radial flow gap between the two wheels which, due to the physical location of the wheels, is established between the two separating stages.

The result is a free-flow gap between the two separating stages, delineated by an upper and a lower rotating wall. The textured surface of the cover disks causes the neighboring layers of air to adhere to the wall. Given that the boundary walls are the cover disks of the wheels which rotate, the rotational movement is in part transferred to these neighboring layers of air. The centrifugal force thus produced hurls the peripheral air layers radially outwards. These peripheral air layers leave the gap and travel across the stream of bulk material, preferably in a flow direction perpendicular to the stream of bulk material. The air current which crosses the stream of material swirls the material particles between the separating stages and disperses them.

This turbulence is enhanced by an air current moving inward into the flow gap, i.e. into the radial center section of the flow gap. The volume of the air layers which next to the wall were hurled outwards and thus removed from the flow gap must be replaced by an equal amount of air. This takes place by the aspiration of separating air from within the separating zone in the radial center of the flow gap. In the process, especially fine particles are also drawn into the flow gap.

The outward air flow at the level of the flow gap in the upper and lower radial area of the gap and the inward air flow in the radial center of the gap combine to produce a rotating eddy current or vortex in the separating zone at the level of the flow gap, whereby the air current produces a particularly intensive dispersion of the bulk material. The local vortex also causes an extended dwell time of the dispersed bulk material particles in the transition zones of the two separating stages.

To control the dispersion and adapt it to the specific requirements relative to the bulk material particles, the strength of the vortex can be increased or decreased as needed.

This can be accomplished by changing the axial height of the flow gap. However, the axial height should be at least five times the value of the largest particle diameter to be separated.

The possible depth of radial inward penetration of the fine particles into the flow gap can be varied by changing the maximum radial depth of the flow gap.

Where the highly sensitive nature of the bulk material does not permit intensive dispersion, the intensity of the vortex can be lessened by the introduction of additional air at the inner radial end of the flow gap, given that the added air reduces the amount of air which is drawn into the flow gap from the separating zone in the dispersion area.

To facilitate quick and frequent product changeover in the air classifier according to this invention, the entire housing structure is designed for easy access, permitting easy and rapid cleaning of the classifier. This minimizes downtime and, consequently, cost Accordingly, the two separator wheels each have their own individual bearings and/or drives. When only one drive is used, the torque is transferred to both wheels by way of a gearbox or a coupling. In the simplest mode involving operation of both wheels at identical speeds, the frontal cover disks of the wheels are connected via a rigid coupling which also serves as a means to limit the radial depth of the flow gap.

The housing is sectionally designed so as to be divisible in the plane of the flow gap. The two housing halves can either be tilted open or pulled apart in their axial direction, with a combination thereof being desirable, whereby one of the housing sections is first separated from the other by axial displacement and can then be tilted open in a second step. The pull-apart and/or tilt-open feature permits easy access to the wheels and the inside of the housing for inspection and cleaning.

In a vertical configuration of the classifier, the bulk material to be separated is fed in from the top. Since in the classifiers according to this invention the feed intake cannot be centered in the top, the intake is located at a point near the outer perimeter. For an even distribution of the material over the circumference of the separator wheels, such even distribution must take place prior to entering the separation zone as a prerequisite for avoiding local material concentrations which would negatively affect the separation process.

To solve this, a feed distributor, located above and extending coaxially with the wheel, is provided in a circular channel which distributes the feed material evenly over the circumference before it enters the separating zone. This distribution is obtained by means of rotating elements which in the preferred design version are attached to the rotating wheel.

The bulk feed material travels to the upper circular disk of the rotating element whose rotation causes it to spread evenly over the entire circumference. The rotation and the resulting centrifugal force move the material particles radially outwards where by gravity they drop through a gap between the rotating elements and the housing wall onto a ledge located underneath the said elements but just above the wheel. Rotor blades evenly spaced underneath the circular disk produce a rotary flow, spinning and dispersing the feed material.

This configuration assures an even distribution and dispersion of the feed particles without having much influence on their properties. The feed material is neither broken down nor can it agglomerate. If, however, the dwell time in the circular channel is to be intentionally extended, the circular disk can be equipped with blades on its top surface so as to subject the material particles to an additional centrifugal effect. This can also serve as an additional means to break down agglomerations. The feed-material distributor can be equally employed in air classifiers with only one separator wheel.

To the extent that the material intake coincides with the carrier-air intake, the intake port may also be located in an angled position, preferably in such fashion that it offers a directional component in a tangential relation to the direction of rotation of the wheel. Particular importance is attributed to tangential devices which extend at a right angle relative to the axis of the wheel, given that a velocity component of the feed material against the direction of rotation of the feed distributor leads to a more intensive dispersion while codirectional movement with the feed distributor yields a smoother dispersion.

BRIEF DESCRIPTION OF THE INVENTION

Figure 1B:
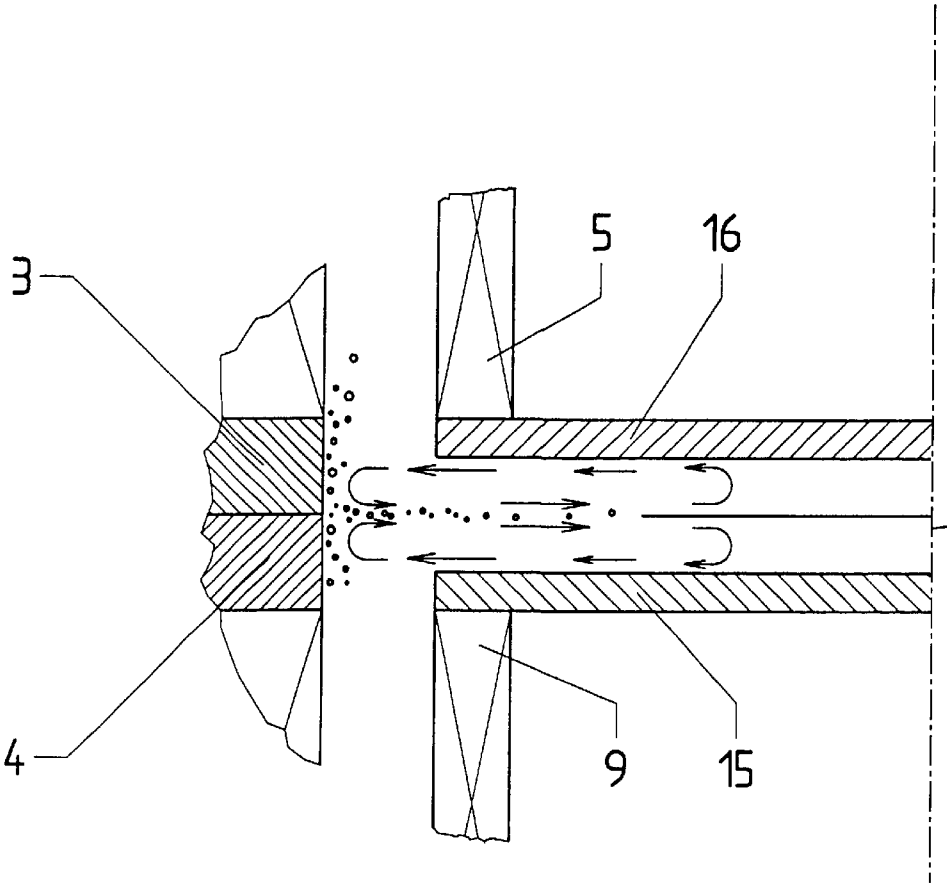

The following describes this invention with the aid of the attached diagrams in which:

FIG. 1*a* shows a classifier according to this invention;

FIG. 1*b* is an enlarged illustration of the encircled portion of the flow gap of the classifier of FIG. 1*a;*

Figure 2C:
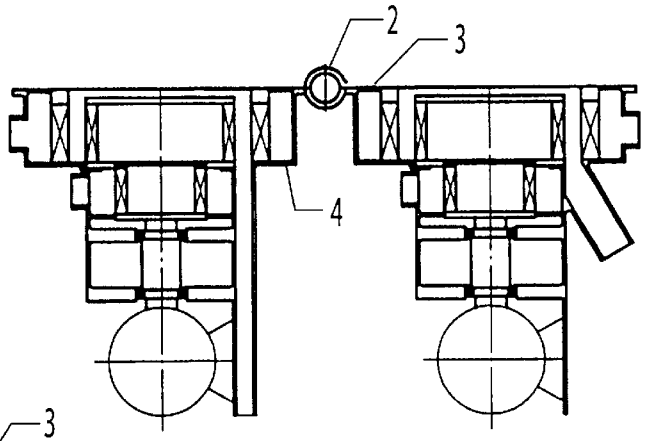
Figure 2B:
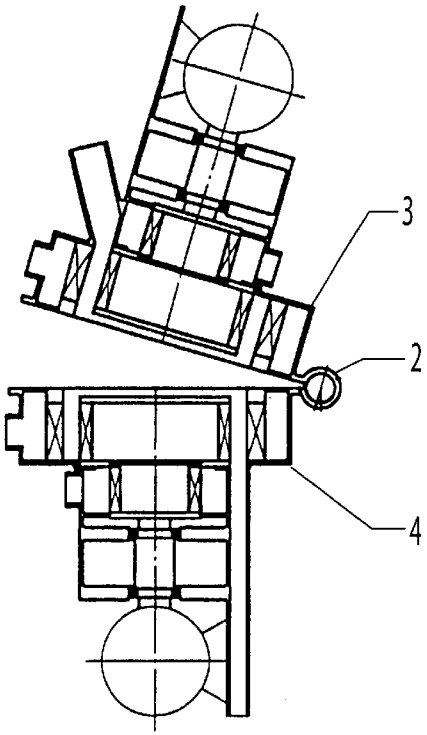
Figure 2A:
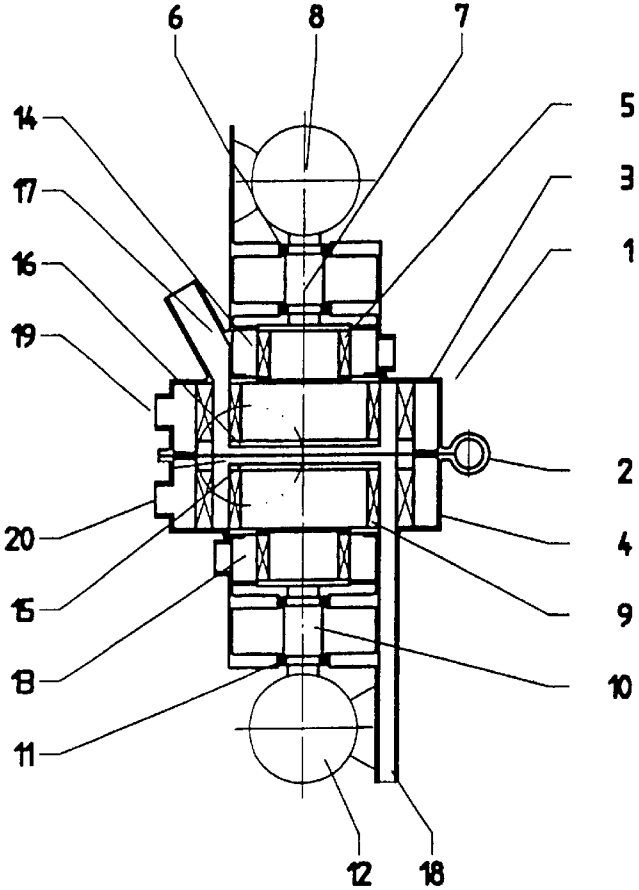
Figure 3C:
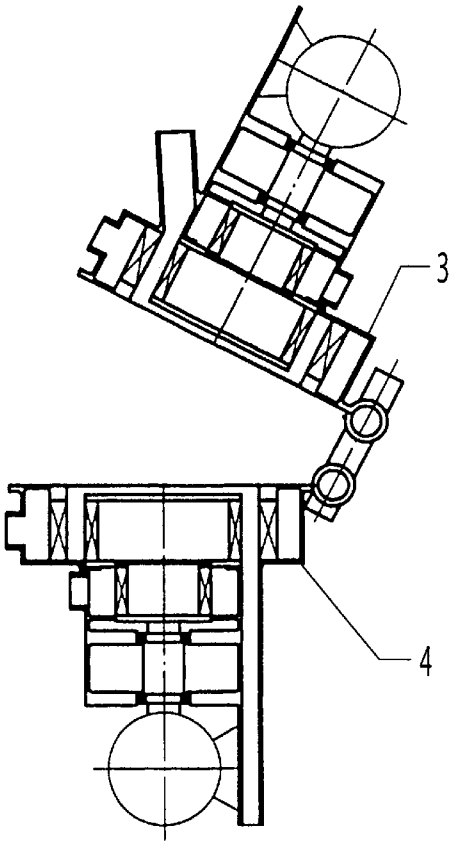
Figure 3B:
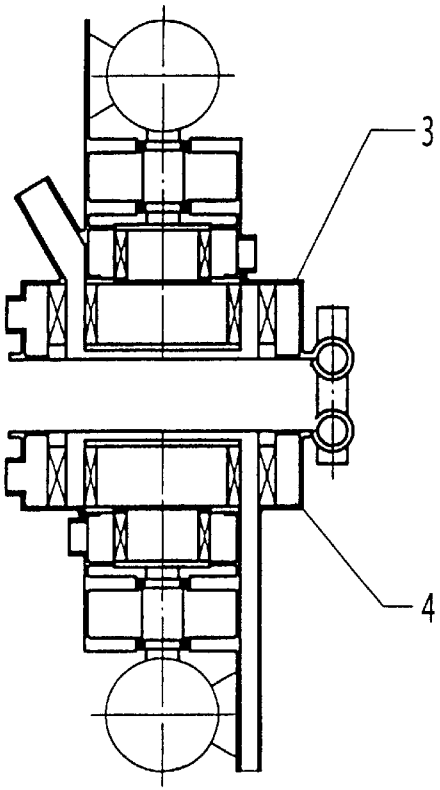
Figure 3A:
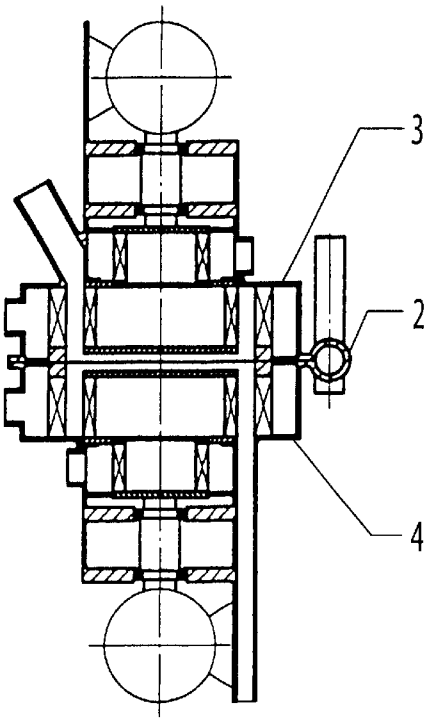
Figure 4B:
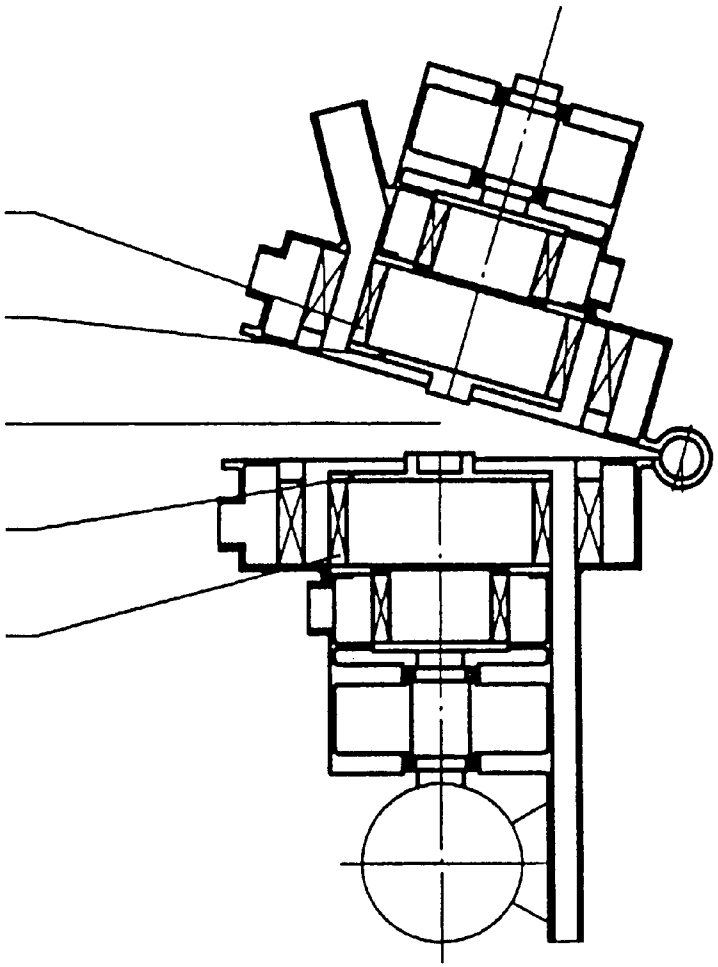
Figure 4A:
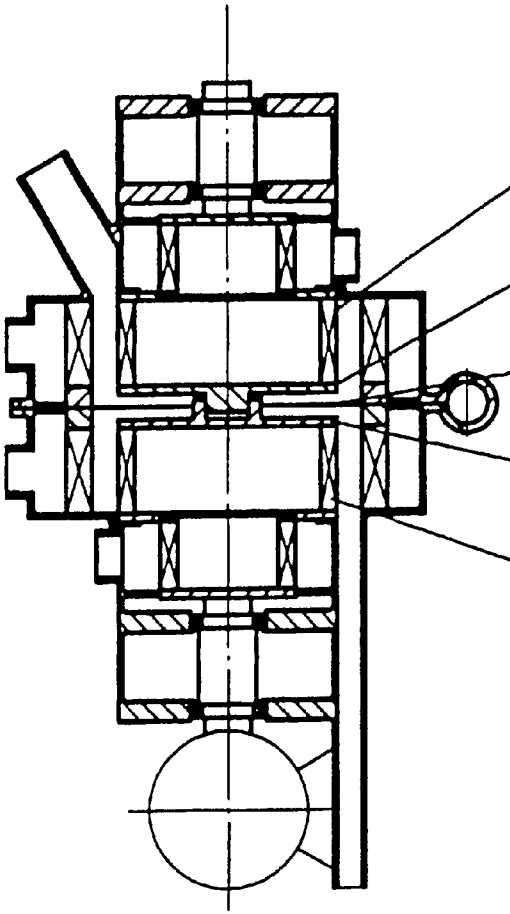
Figure 5B:
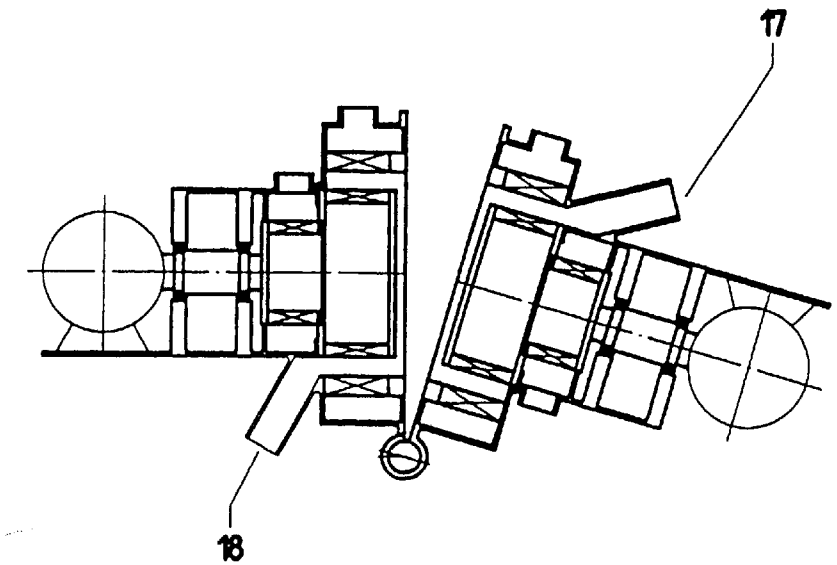
Figure 5A:
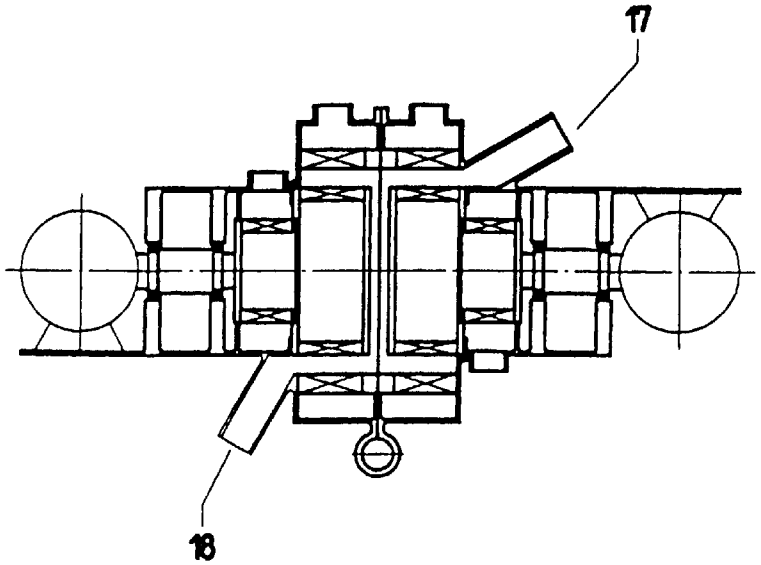
Figure 6:
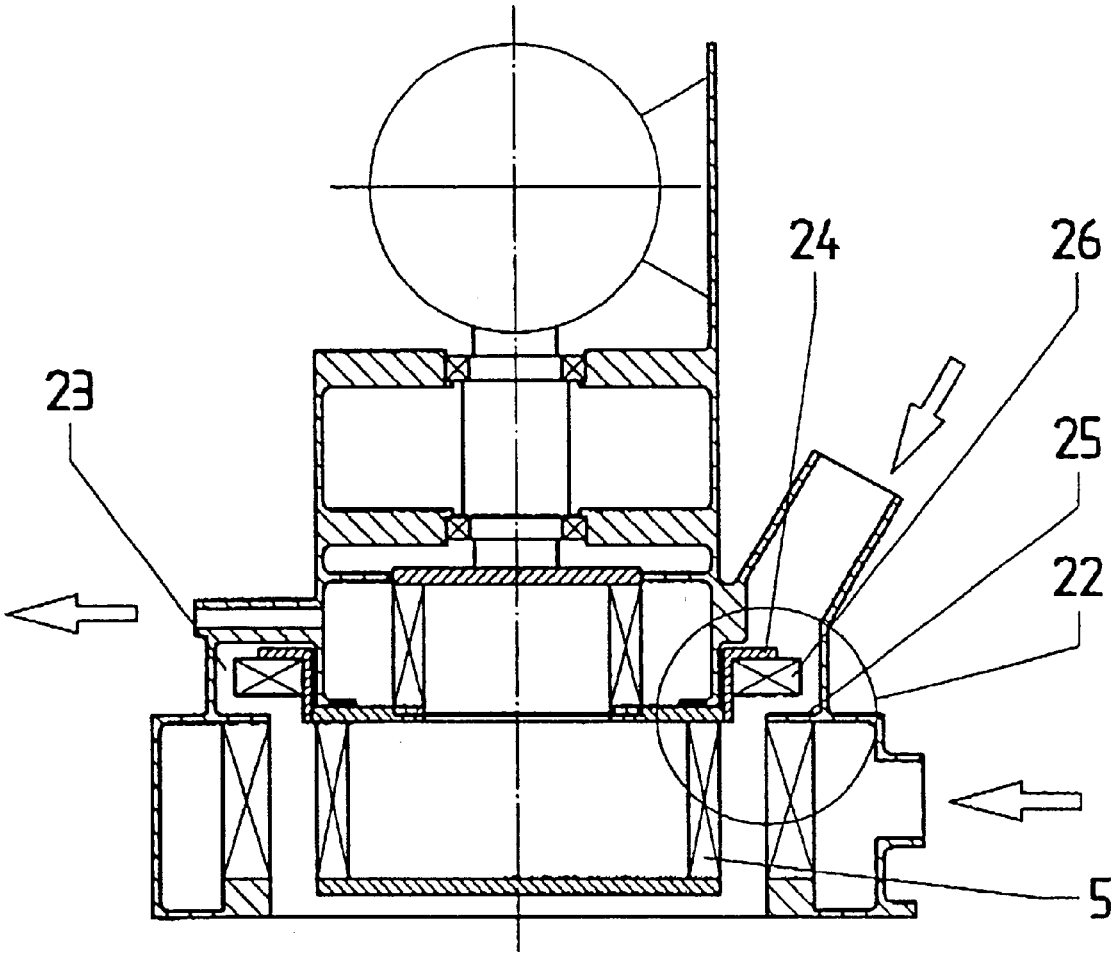

FIGS. 2*a*–2*c* show a sequence of steps for opening the sectional housing, here by tilting;

FIGS. 3*a*–3*c* show a sequence of steps for opening the sectional housing by displacement and tilting;

FIG. 4*a* illustrates a classifier according to this invention in which the second separator wheel is driven by the first wheel by way of a coupling;

FIG. 4*b* illustrates the classifier of FIG. 4*a* in uncoupled relationship;

FIG. 5*a* shows a classifier according to this invention in a horizontal configuration;

FIG. 5*b* shows the classifier of FIG. 5*a* in opened relationship;

FIG. 6 illustrates the feed material distributor with the rotating elements for the distribution and dispersion of the feed material; and FIGS. 7–10 show enlarged views of different embodiments of the feed material distributor of FIG. 6.

DETAILED DESCRIPTION OF THE INVENTION

The air classifier 1 illustrated in FIG. 1*a* consists of a sectional housing that can be opened via a hinge 2, with an upper housing section 3 and a lower housing section 4 accommodating the two separator wheels 5 and 9. The first wheel 5 is located in the upper housing section 3 and, mounted in a bearing 6, rotates with a drive shaft 7. The wheel 5 is driven by a drive motor 8 which is connected to the wheel via the drive shaft 7.

The lower, mirror-image housing section 4 accommodates the second separator wheel 9 with its own drive shaft 10 rotatably mounted in the bearing 11. The separating wheel 9 is driven by a drive motor 12 which connects to the wheel 9 via the drive shaft 10.

Each wheel 5 and 9 constitutes a separating wheel in a laterally offset position, with the drive shafts 7 and 10, the fine-particle discharge chambers 13 and 14 as well as the wheel bearings 6 and 11 located on the same side. On the opposite side the wheels 5 and 9 are provided with a closed cover disk 15 and 16, respectively.

A feed port 17 is located above the first, upper wheel 5, serving as the intake by way of which, at a point along the perimeter, the feed material to be separated is introduced. An exit port 18 for the coarse material is located underneath the lower wheel 9. The separating air is introduced at the radial perimeters of the wheels 5 and 9 by way of the two tangential air intakes 19 and 20.

In the air classifier 1 the wheels 5 and 9 are mounted in a mirror-image position relative to each other so that the two cover disks 15 and 16 face each other at a distance and in parallel planes. This arrangement of the cover disks 15 and 16 creates a gap as shown in an enlarged sectional view in FIG. 1*b*.

As indicated in FIG. 1*b,* feed material particles drop down around and along the outer circumference of the two wheels 5 and 9. Due to the rotation of the two wheels 5 and 9 and of their rotating cover disks 15 and 16 the air that is present near the wall of the rotating cover disks 15 and 16 is pushed outwards, taking particles with it, carrying them into the center of the flow gap and dispersing them.

FIG. 2 shows a sequence of steps for tilt-opening the sectional housing.

FIG. 3 shows a sequence of steps for opening the sectional housing by axial displacement and tilting. When the housing is fully tilted open, the wheels can be easily detached from their drive shafts, pulled up and removed from the housing. Since the entire housing is designed essentially without compartments, quick and easy cleaning is assured.

In FIG. 4, the upper wheel 5 does not have a drive motor of its own. Instead, the wheel 5 is connected with the drive-operated wheel 9 via a coupling 21 mounted on the cover disks 15 and 16.

FIG. 5 shows the location of the port 17 for the intake of the feed material and the output port 18 for the discharge of the coarse particles, the design shown lending itself well to the operation of an air classifier 1 in an axially horizontal configuration.

FIG. 6 shows the feed material distributor 22 with the rotating elements for the distribution and dispersion of the bulk feed material. Within the circular channel 23, a circular disk 24 connects to the classifying wheel 5 in coaxial, rotating fashion. The feed material distributor interacts with the ledge 25 in the housing wall. The dispersion blades 26, evenly spaced around the perimeter of the circular disk 24, are located underneath that circular disk 24. As an option, additional blades 27 may be mounted above the rotating circular disk 24.

Figure 7:
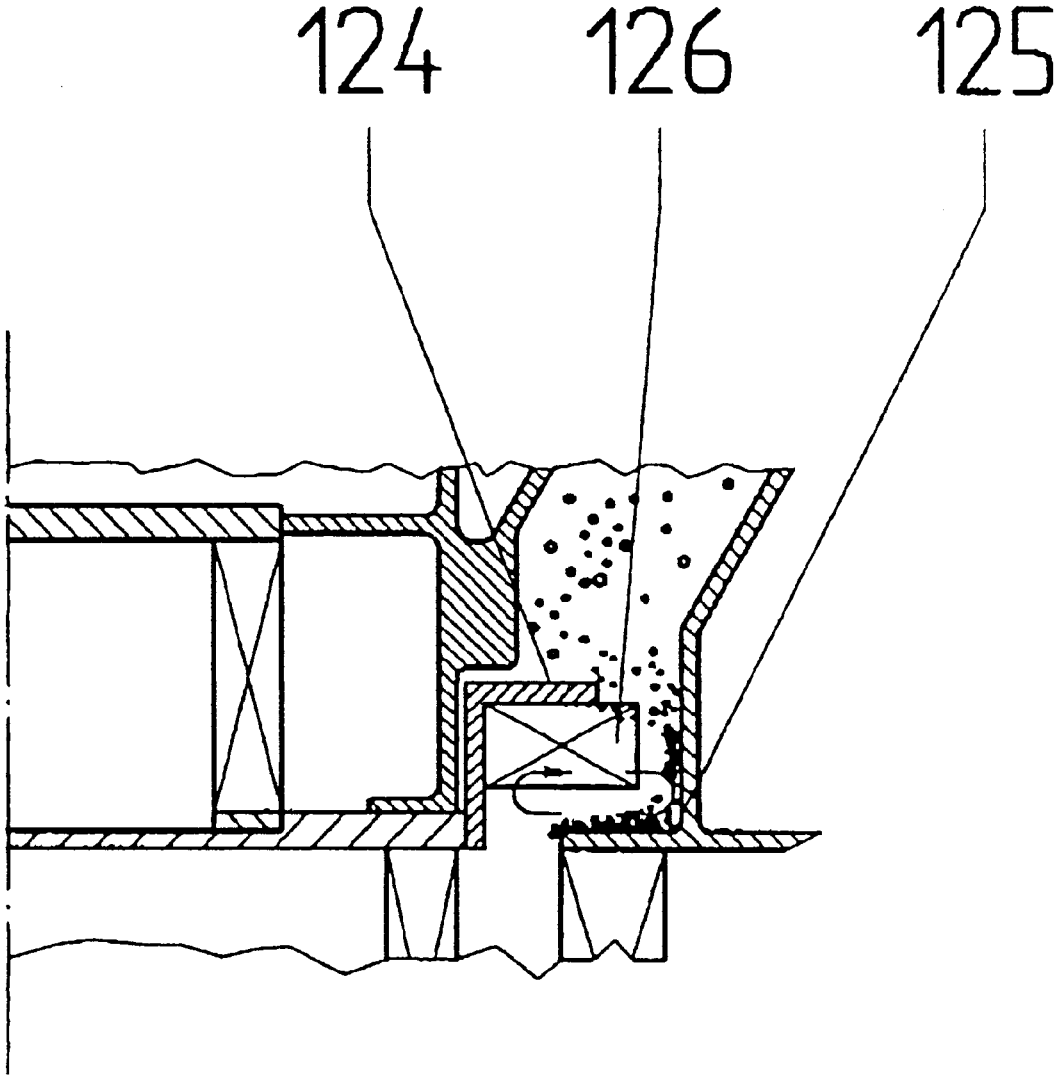

FIG. 7 shows a close up view of the feed material distributor 22 according to FIG. 6. The rotating circular disk 124 will force the material in a horizontal direction to spread evenly over the entire circumference. The outer diameter of the circular disk 124 is less than the outer diameter of the dispersing blades 126. Therefore, in vertical downward direction a certain amount of material can enter the spaces between each two dispersion blades 126 by gravity. Due to impact forces between the material particles and the rotating dispersion blades 126 the material is desaggromerate before entering the classifying zone underneath the dispersion blades 126.

Figure 8:
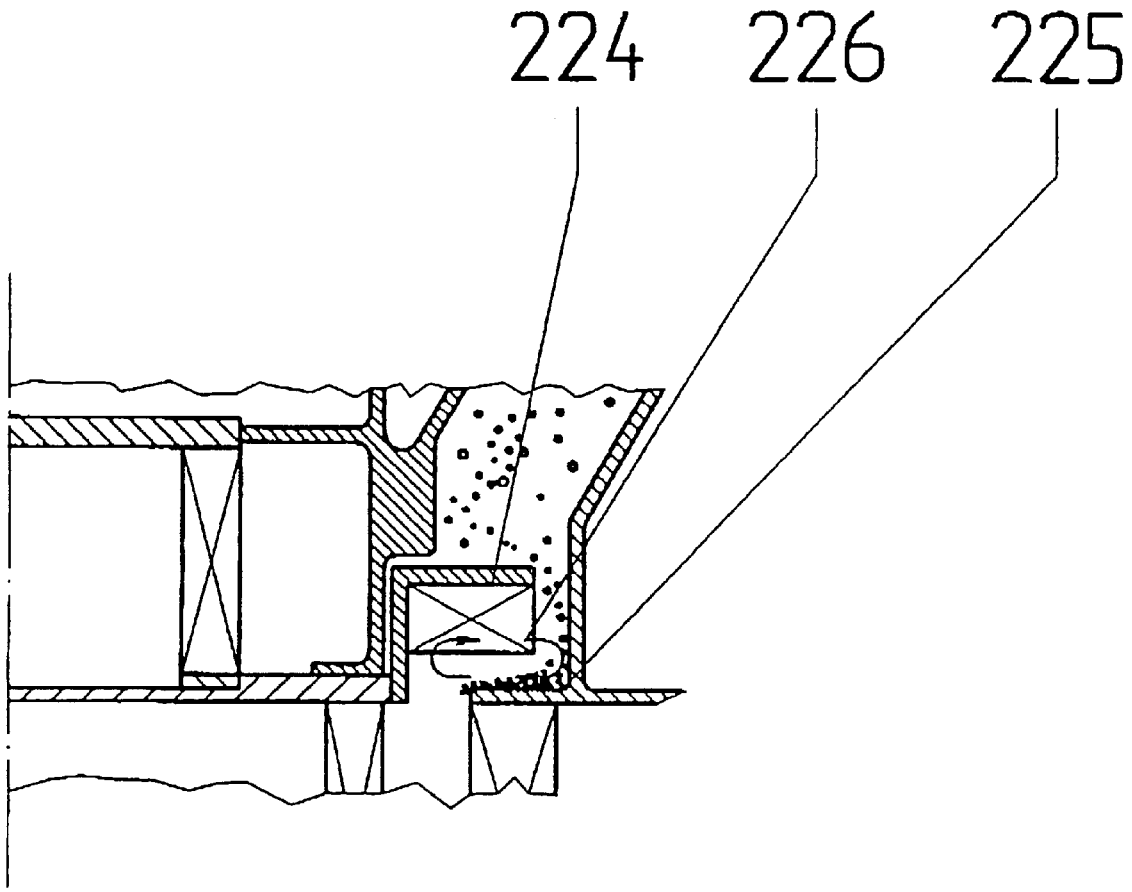

FIG. 8 shows an embodiment for use in the classification of sensitive material like toner particles. The circular disk 224 extends to the outer diameter of the dispersion blades 226. Therefore, the material cannot enter the spaces between the dispersion blades 226 from a vertical downward direction. This avoids impact forces on the material particles caused by the rotating dispersion blades 226. Only the air flow caused by the rotating dispersion blades 226 will lead to spinning and dispersing the feed material in the area of the ledge 225.

Figure 9:
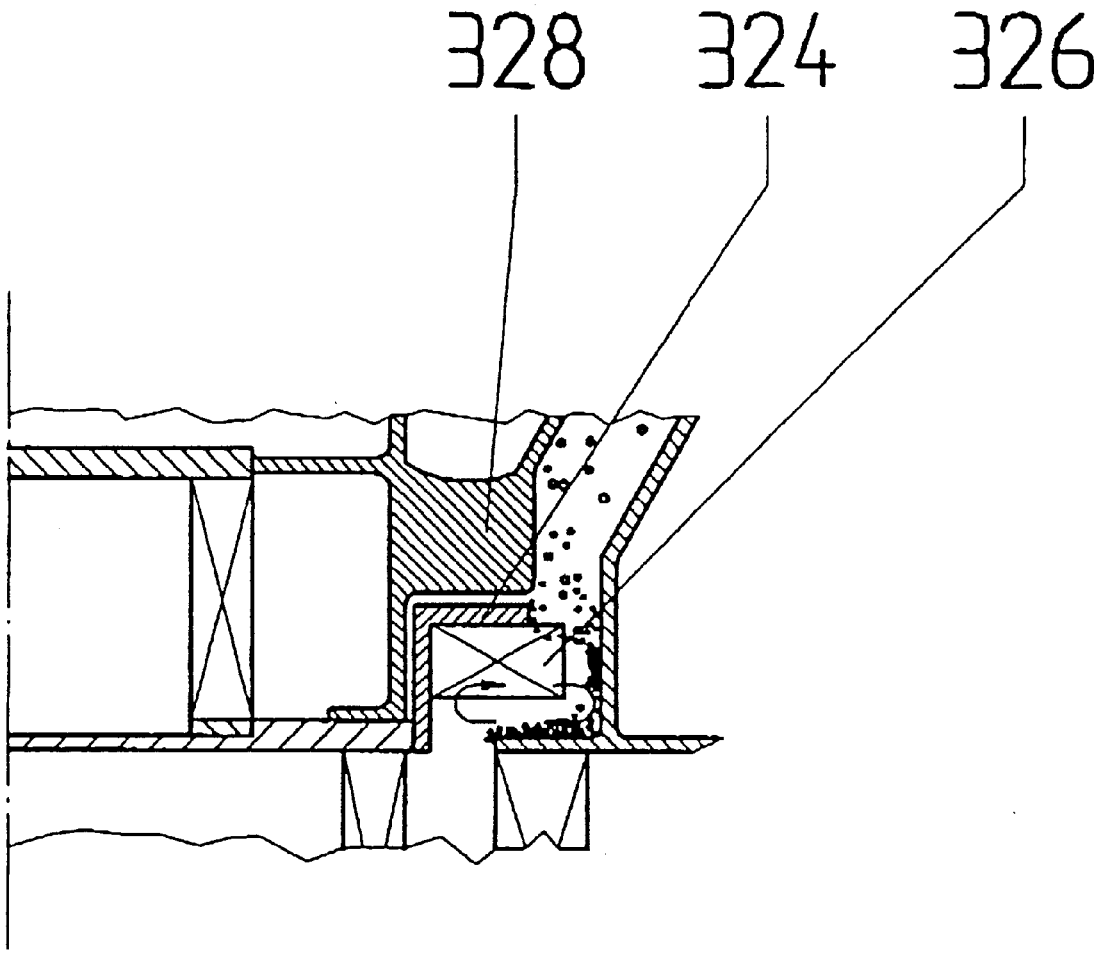

FIG. 9 shows an embodiment without using the functional features of the circular disk 324, since the circular disk 324 is covered in its total by a covering portion 328 of the housing. Therefore, the material is only dispersed by impact forces due to the rotating dispersion blades 326.

Figure 10:
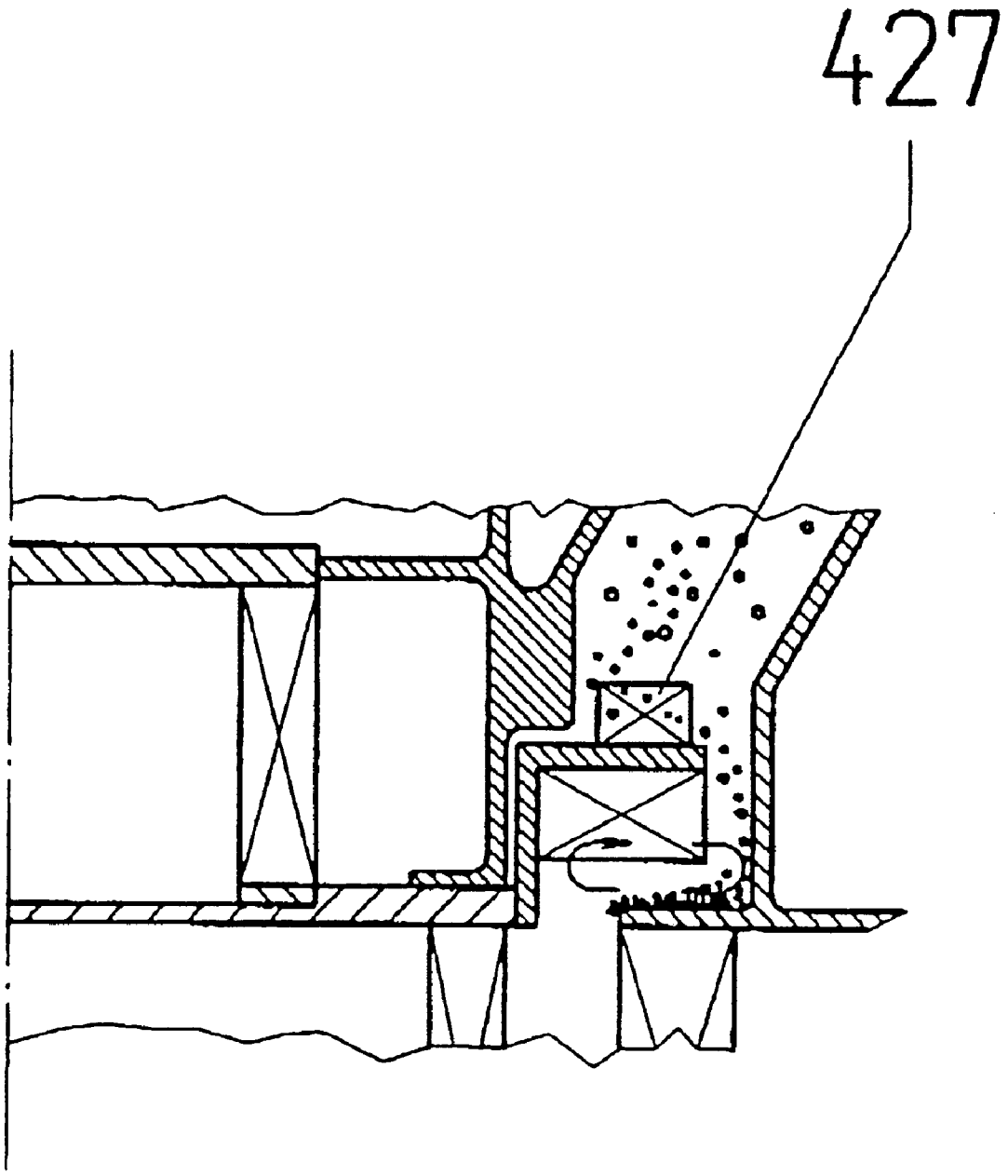

FIG. 10 shows an embodiment with additional blades 427 for a very high dispersion effect due to the high impact forces acting on the feed material before distribution.

We claim:

1. Air classifier for the separation of granular material into three fractions, comprising two motor-driven rotor blade-equipped separator wheels each of which is mounted on one side in a common housing, each with a tangential separating-air intake at the level of the respective wheel and with a guide vane ring which is positioned at a radial distance from the circumference of the wheel, with a bulk material feed intake and with exit ports for the discharge of fine, medium and coarse fractions and with a separation zone through which a stream of the granular material flows along the direction of the longitudinal axis of the wheels, wherein each of the wheels comprises at a first axial end thereof a closed cover disk and at its second axial end with a fine and, respectively, medium fraction discharge port, the wheels having first ends that are spaced from, generally in parallel with, and frontally facing each other and forming a radial flow gap that is open to the stream of granular material for receiving a portion of the stream to flow radially through the gap, wherein the spacing between the first ends of the wheels is adjustable to vary the axial extension of the flow gap.

2. Air classifier as in claim 1, wherein the axial extension of the flow gap is of at least five times the magnitude of the largest particle diameter to be separated.

3. Air classifier as in claim 1, wherein the radial depth of the gap is limited.

4. Air classifier as in claim 1, wherein at least one of the cover disks is provided with a textured surface.

5. Air classifier as in claim 1, wherein the fine-particle and medium-particle exit ports merge in a common discharge port.

6. Air classifier as in claim 1, wherein the second separator wheel is driven by a torque transfer from the first wheel.

7. Air classifier as in claim 6, wherein the torque is transferred by a gear system.

8. Air classifier as in claim 1, wherein a bulk feed material distributor is positioned in a circular channel above, and coaxially with, the first separator wheel.

9. Air classifier as in claim 8, wherein the bulk feed material distributor is composed of a rotating circular disk equipped on its underside with rotor blades evenly spaced along its perimeter and interacts with a fixed ledge in the housing underneath the said rotor blades.

10. Air classifier for the separation of granular material into three fractions, comprising two motor-driven rotor blade-equipped separator wheels each of which is mounted on one side in a common housing, each with a tangential separating-air intake at the level of the respective wheel and with a guide vane ring which is positioned at a radial distance from the circumference of the wheel, with a bulk material feed intake and with exit ports for the discharge of fine, medium and coarse fractions and with a separation zone through which a stream of the granular material flows along the direction of the longitudinal axis of the wheels, wherein each of the wheels comprises at a first axial end thereof a closed cover disk and at its second axial end with a fine and, respectively, medium fraction discharge port, the wheels having first ends that are spaced from, generally in parallel with, and frontally facing each other and forming a radial flow gap that is open to the stream of granular material for receiving a portion of the stream to flow radially through the gap, wherein the radial depth of the gap is limited by a ledge on at least one of the cover disks.

11. Air classifier for the separation of granular material into three fractions, comprising two motor-driven rotor blade-equipped separator wheels each of which is mounted on one side in a common housing, each with a tangential separating-air intake at the level of the respective wheel and with a guide vane ring which is positioned at a radial distance from the circumference of the wheel, with a bulk material feed intake and with exit ports for the discharge of fine, medium and coarse fractions and with a separation zone through which a stream of the granular material flows along the direction of the longitudinal axis of the wheels, wherein each of the wheels comprises at a first axial end thereof a closed cover disk and at its second axial end with a fine and, respectively, medium fraction discharge port, the wheels having first ends that are spaced from, generally in parallel with, and frontally facing each other and forming a radial flow gap that is open to the stream of granular material for receiving a portion of the stream to flow radially through the gap, wherein the classifier is configured for introducing an additionally introduced fluid directly into the flow gap at a radially inward location to flow through the flow gap from the inward location toward the outside of the flow gap.

12. Air classifier for the separation of granular material into three fractions, comprising two motor-driven rotor blade-equipped separator wheels each of which is mounted on one side in a common housing, each with a tangential separating-air intake at the level of the respective wheel and with a guide vane ring which is positioned at a radial distance from the circumference of the wheel, with a bulk material feed intake and with exit ports for the discharge of fine, medium and coarse fractions and with a separation zone through which a stream of the granular material flows along the direction of the longitudinal axis of the wheels, wherein each of the wheels comprises at a first axial end thereof a closed cover disk and at its second axial end with a fine and, respectively, medium fraction discharge port, the wheels having first ends that are spaced from, generally in parallel with, and frontally facing each other and forming a radial flow gap that is open to the stream of granular material for receiving a portion of the stream to flow radially through the gap, wherein in the plane of the flow gap the housing is sectionally divisible.

13. Air classifier for the separation of granular material into three fractions, comprising two motor-driven rotor blade-equipped separator wheels each of which is mounted on one side in a common housing, each with a tangential separating-air intake at the level of the respective wheel and with a guide vane ring which is positioned at a radial distance from the circumference of the wheel, with a bulk material feed intake and with exit ports for the discharge of fine, medium and coarse fractions and with a separation zone through which a stream of the granular material flows along the direction of the longitudinal axis of the wheels, wherein each of the wheels comprises at a first axial end thereof a closed cover disk and at its second axial end with a fine and, respectively, medium fraction discharge port, the wheels having first ends that are spaced from, generally in parallel with, and frontally facing each other and forming a radial flow gap that is open to the stream of granular material for receiving a portion of the stream to flow radially through the gap, wherein the first and second wheels are associated such that the torque is transferred from the first wheel to the second wheel to drive the second wheel by way of a coupling on the front faces of the wheels.

14. Air classifier for the separation of granular material into three fractions, comprising two motor-driven rotor blade-equipped separator wheels each of which is mounted on one side in a common housing, each with a tangential separating-air intake at the level of the respective wheel and with a guide vane ring which is positioned at a radial distance from the circumference of the wheel, with a bulk material feed intake and with exit ports for the discharge of fine, medium and coarse fractions and with a separation zone through which a stream of the granular material flows along the direction of the longitudinal axis of the wheels, wherein each of the wheels comprises at a first axial end thereof a closed cover disk and at its second axial end with a fine and, respectively, medium fraction discharge port, the wheels having first ends that are spaced from, generally in parallel with, and frontally facing each other and forming a radial flow gap that is open to the stream of granular material for receiving a portion of the stream to flow radially through the gap wherein the two wheels are driven in mutually opposite directions.

* * * * *